US009592929B2

(12) United States Patent
Marconel Carpio et al.

(10) Patent No.: US 9,592,929 B2
(45) Date of Patent: Mar. 14, 2017

(54) DISMANTLABLE SELF-ASSEMBLY STRUCTURE

(71) Applicant: Avantpack S.L., Valencia (ES)

(72) Inventors: Jose Luis Marconel Carpio, Valencia (ES); Tomas Andres Garcia Guillen, Valencia (ES)

(73) Assignee: Avantpack S.L., Valencia (ES)

( * ) Notice: Subject to any disclaimer, the term of this patent is extended or adjusted under 35 U.S.C. 154(b) by 0 days.

(21) Appl. No.: 14/761,596

(22) PCT Filed: Jan. 16, 2014

(86) PCT No.: PCT/ES2014/070023

§ 371 (c)(1),
(2) Date: Jul. 16, 2015

(87) PCT Pub. No.: WO2014/111610

PCT Pub. Date: Jul. 24, 2014

(65) Prior Publication Data

US 2015/0360808 A1 Dec. 17, 2015

(30) Foreign Application Priority Data

Jan. 17, 2013 (ES) ..... 201330046
Oct. 31, 2013 (ES) ..... 201331602

(51) Int. Cl.
*B65D 19/00* (2006.01)

(52) U.S. Cl.
CPC ..... *B65D 19/0073* (2013.01); *B65D 19/0095* (2013.01); *B65D 2519/00273* (2013.01);
(Continued)

(58) Field of Classification Search
CPC ..... B65D 19/0073; B65D 19/0053; B65D 19/0067; B65D 19/0085;
(Continued)

(56) References Cited

U.S. PATENT DOCUMENTS 2,450,432 A * 10/1948 Lehrman ..... B65D 19/0095 108/57.1
3,381,428 A * 5/1968 Sillman ..... E04B 2/702 217/65
(Continued)

FOREIGN PATENT DOCUMENTS

ES 245986 U 5/1980
ES 1018770 U 2/1992
(Continued)

*Primary Examiner* — Janet M Wilkens
(74) *Attorney, Agent, or Firm* — Wiggin and Dana LLP; Gregory S. Rosenblatt; Jonathan D. Hall

(57) ABSTRACT

Disclosed is a self-assembly formed by a series of longitudinal members and cross members, all of the longitudinal members being identical to one other and all of the cross members being identical to one other, such that only two types of parts are required to construct the structure. Owing to the shape of the parts, they can be assembled to one another to create a solid structure without requiring any other connecting materials or elements. The longitudinal members comprise a series of slots into which narrowed segments of the cross members are inserted. Once the cross members have been inserted into the slots they are trapped therein by moving the longitudinal members and, in order to prevent this movement occurring in the opposite direction, other cross members are inserted into slots provided in the longitudinal members for this purpose.

7 Claims, 6 Drawing Sheets

(52) U.S. Cl.
CPC ..... *B65D 2519/00293* (2013.01); *B65D 2519/00323* (2013.01); *B65D 2519/00333* (2013.01); *B65D 2519/00567* (2013.01); *B65D 2519/00985* (2013.01)

(58) Field of Classification Search
CPC ..... B65D 2519/00985; B65D 2519/00273; B65D 2519/00293; B65D 2519/00567; Y10T 403/7129; Y10T 403/7141; Y10T 403/38
USPC ..... 52/667, 668, 480; 446/106, 105, 85; 108/56.1, 56.3, 57.17, 57.18, 57.19; 403/389, 391, 186
See application file for complete search history.

(56) References Cited

U.S. PATENT DOCUMENTS 3,676,969 A * 7/1972 Moore ..... E04B 2/08 403/339
4,077,334 A * 3/1978 Svirklys ..... B65D 19/0095 108/56.1
4,145,976 A * 3/1979 Svirklys ..... B65D 19/0095 108/56.1
4,220,099 A * 9/1980 Marchesano ..... B65D 19/0069 108/57.1
4,270,304 A * 6/1981 Sofer ..... A63H 33/084 446/106
4,869,179 A * 9/1989 Sammons ..... B65D 19/0073 108/56.1
4,898,102 A * 2/1990 Thebeau ..... B65D 19/0095 108/55.3
5,417,167 A * 5/1995 Sadr ..... B65D 19/0093 108/57.19
5,461,988 A * 10/1995 Cummings ..... B65D 19/0075 108/51.3
6,029,582 A 2/2000 Olvey et al.
6,094,876 A * 8/2000 Ogo ..... E04B 2/702 446/106
8,113,129 B1 2/2012 Hurley et al.
8,464,647 B1 * 6/2013 Chernek ..... B65D 19/0095 108/56.1
2006/0053720 A1 * 3/2006 Oh ..... E04D 11/005 52/480
2006/0096508 A1 * 5/2006 Herring ..... B65D 19/0095 108/54.1
2007/0221537 A1 9/2007 MacQueen et al.
2008/0032586 A1 * 2/2008 Dyer ..... A63H 33/08 446/85
2009/0298015 A1 12/2009 Al-Attar
2012/0132114 A1 * 5/2012 Krupka ..... B65D 19/0095 108/57.25
2012/0298015 A1 * 11/2012 Jian ..... B65D 19/0097 108/56.1
2014/0251188 A1 * 9/2014 Jordan ..... B65D 19/0012 108/51.3
2015/0203246 A1 * 7/2015 Machrowicz ..... F16M 13/00 248/558

FOREIGN PATENT DOCUMENTS

ES 1033284 U 8/1996
ES 2127223 T3 4/1999
ES 2350518 T3 1/2011
ES 1077901 U 10/2012
FR 2309417 * 11/1976
FR 2407864 * 6/1979
FR 2604978 A1 4/1998
JP 2002019780 * 1/2002
KR 100891038 * 3/2009
WO 9113009 A1 9/1991
WO 9310011 A1 5/1993
WO 2013060900 * 1/2013

* cited by examiner

DISMANTLABLE SELF-ASSEMBLY STRUCTURE

The present invention, as indicated by its name, relates to a self-assembly structure consisting of a series of longitudinal and cross members which, due to their shape, can be assembled to each other generating a solid structure without requiring any additional connecting element or material.

The construction and assembly of the structure requires only two types of parts which, arranged differently depending on the intended purpose thereof, manage to compose and provide solidity to the structure.

The field of the art to which it belongs is that of transportable structures.

BACKGROUND OF THE INVENTION

Although the type of structure disclosed can have many uses and applications, it is optimal for use as a transportation pallet; in fact, this is a sector in which the closest prior art documents, discussed below, have been found.

Pallets have been used for a long time to transport loads. However, said pallets must make several trips without a load.

In long-distance hauls the cost of returning the pallets due to their bulk makes the recovery thereof uneconomical.

It is also not easy to sell new pallets to distant locations as the trip between the manufacturer and the first user is also performed without a load.

In order to favour the transport of many pallets in a single transport unit, such as a truck or container, dismantlable pallets have been conceived which, after they are used with a load in a transport, can be dismantled to optimise space.

Dismantlable pallets also favour the replacement of broken parts, as in non-dismantlable pellets a broken part often makes the pallet unusable, with the ensuing economic and environment cost.

Among the antecedents of dismantlable pallets are the following:

Utility model ES245986 relates to a dismantlable pallet, which requires for rigidity of the assembly that the longitudinal members be attached to each other both on the top and bottom, increasing the number of parts used in the assembling process.

Utility model ES1018770U relates to a dismantlable pallet the various elements of which are joined to each other by a series of lugs crossed by rods, thus requiring said union elements as well as the longitudinal and cross members that form the structure itself.

Utility model ES1033284U relates to dismantlable pallet the parts of which are attached to each other by a sandwich arrangement wherein protrusions have been added to the central part allowing assembly with orifices made in the outer parts. This solution presents some manufacturing drawbacks mainly resulting from the protrusions that must be attached to the slat at a later stage, as well as transportation problems as the protrusions prevent optimising space in the transport when the pallet is transported dismantled.

Utility model ES1077901U relates to a self-assembly pallet configured on the basis of a horizontal platform provided with tab-like incuts such that these tabs must be able to deform in order to assume a vertical position, thereby limiting the materials that can be used with this technical solution.

Patent EP0516681 published in Spain as ES2093698 relates to a dismantlable pallet consisting of two hollow metal longitudinal members facing one another, the sides facing each other having a number of orifices in which can be inserted cross members provided on the bottom face thereof with slots with the appropriate arrangement and shape to rest on the inner vertical walls of said longitudinal members. This technical solution requires the longitudinal members to be metallic.

Patent US2007/0221537 relates to a three-dimensional structure made from several parts that assemble on each other wherein said parts are made or at least filled with several layers of cardboard and corrugated paper. This patent requires several different types of parts for the execution thereof. In addition, the assemblies produce protrusions in the structure that hinder the handling and storage thereof.

U.S. Pat. No. 8,113,129 relates to a pallet formed by different parts, longitudinal and cross members, that are assembled to each other, each on of these longitudinal and cross members consisting of two parts which when joined trap the part on which they cross and are in turn trapped in the same. The assembly thus obtained produces protrusions that hinder the storage and handling of the pallet.

Patent US2009/0298015 relates to a dismantlable pallet formed by a number of parts, longitudinal and cross members, which cross to form the pallet and are joined by clips, the union being reinforced by rods that cross the members longitudinally after the pallet has been assembled. This patent requires several different parts and rods and due to the union method protrusions are created that hinder the handling and storage of the pallet.

BRIEF DESCRIPTION OF THE INVENTION

To overcome the aforementioned drawbacks a dismantlable structure is proposed that can be used as a pallet, for which reason most of the prior art relates to pallets and the explanation and examples of embodiments also relate to pallets, as this is the field that appears optimal for exploitation thereof. For this reason, the term pallet will be used, although it is meant to include all other structures.

The pallet does not require screws or any additional elements to secure its unions, which is advantageous particularly for recycling purposes as it does not require the step of dismantlable and separating materials.

This pallet can be made of any sufficiently rigid material; tests have been conducted with wood, plastic and even cardboard with outstanding results.

In addition, the simplicity of the unions thereof allows assembling the structure with only two types of parts.

The self-assembly structure is made from a specific number of two types of parts which, arranged differently, fulfil different functions in the structure. These parts are:

- Longitudinal member part which presents on the top part thereof a number of slots. These slots are prolonged on the bottom and, at some point in their path, move toward or away from the vertical axis of the longitudinal member. These longitudinal members are provided, also on their top part, with slots preferably arranged symmetrically with respect to the vertical axis of the member, and, at their bottom, with at least one cut-out, preferably two, in which can be inserted the skids of a forklift, these two cut-outs preferably arranged symmetrically with respect to the vertical axis of the member.
- Cross member presenting a number of narrowed segments. The narrowed segments are preferably made in both thickness and width. Thickness narrowed segments do not affect the two faces of the member identically. Instead, a narrowed segment is made on one of the faces and in the other the narrowed part remains flush with the surface of the member.

As indicated the slots at some point in their path lose their vertical position with respect to the opening, moving towards the vertical axis of the member or away from the vertical axis of the member.

Said loss of vertical position at some point of the path includes all slot shapes other than strictly vertical slots that remain in their entire path at a right angle to the surface of the part.

Such slots can adopt many possible shapes, such as L, J or C shapes.

The tests performed have led to selecting an L-shaped slot, although other options are not ruled out.

The longitudinal members have a greater thickness in the bottom part than in the top part thereof, with a cut-out determining the difference in thickness.

To assemble the pallet the longitudinal members are placed parallel to each other, at least one of them in the opposite direction to the others, that is, parallel but with a 180° rotation about the vertical axis.

In a preferred embodiment the longitudinal members alternate in direction, with one in one direction and the next in the opposite direction and so on.

To assemble the pallet the longitudinal members must be arranged such that the openings of their corresponding slots are aligned.

The cross members are introduced in the slots at the narrow ends thereof.

With the cross members inserted in the slots, the longitudinal members are displaced longitudinally, each one in the appropriate direction, until the slots thereof are aligned.

Once the longitudinal member slots have been aligned, additional cross members are placed in said slots.

In a preferred embodiment the cross members are inserted in the slots with the recessed part of the narrowed segment facing up and inserted in the slots with the recessed part of the narrowed segment facing down.

The pallet configured in this manner is strong, solid, does not have any protrusions on the sides thereof as the end of the cross members, needed to act as a stop and prevent the longitudinal members from coming out, is flush with the thickest part of the cross members.

In a preferred embodiment the cross members have a considerable width in order to provide a large support surface for the goods placed on the pallet, also allowing the sides of the cross members to be flush with the ends of the longitudinal members, thereby preventing protrusions that hinder the handling and storage of assembled pallets.

The longitudinal members present cut-outs on the bottom part thereof allowing the skids of a forklift to be introduced therein.

These cut-outs, present in one way or another in many pallets, make it impossible to transport the parts or the assembled pallets with a roller system, such that in a preferred embodiment of the invention these cut-outs have been provided with a tie rod that is flush with the bottom surface of the longitudinal members.

DETAILED DESCRIPTION

Figure 1:
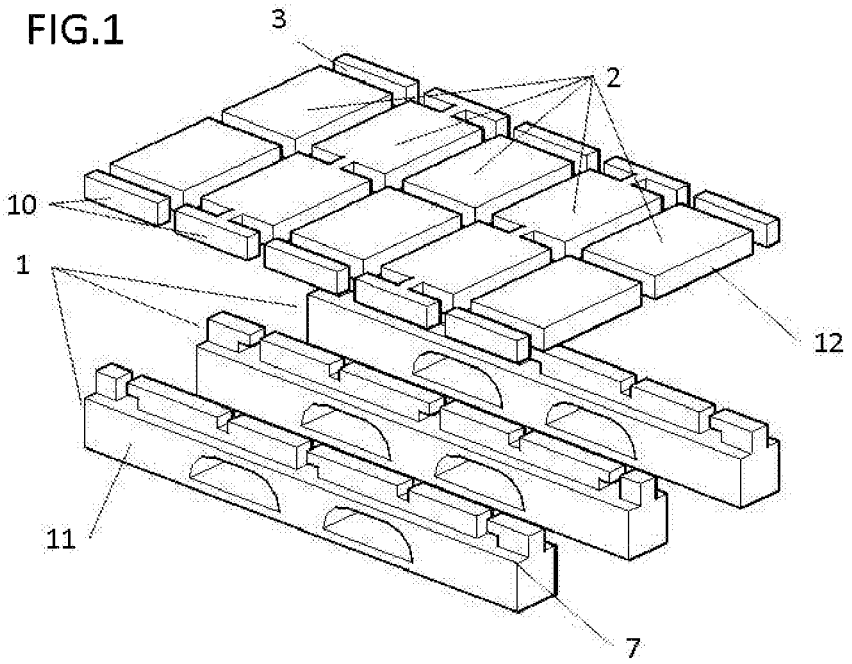
FIG. 1 shows an exploded view of the part of a pallet, showing the longitudinal members (1) with the sides (11) provided with a recess (7), the central longitudinal member being in the opposite position to the other two; the cross members (2); the ends (10) and the sides (12) of the cross members (2); the cross members being arranged alternately having the recess of the narrowed segment (3) on the top and the next with the recess of the narrowed segment on the bottom.
Figure 2:
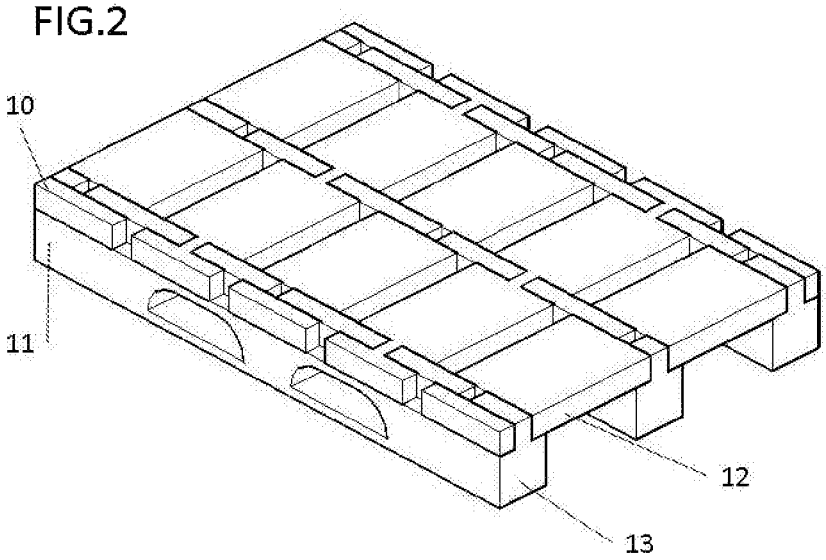
FIG. 2 shows the pallet assembled, showing that there are no protruding elements on the periphery thereof as the ends (10) of the cross members are flush with the sides (11) of the longitudinal members and the sides (12) of the cross members are flush with the ends (13) of the longitudinal members.
Figure 3:
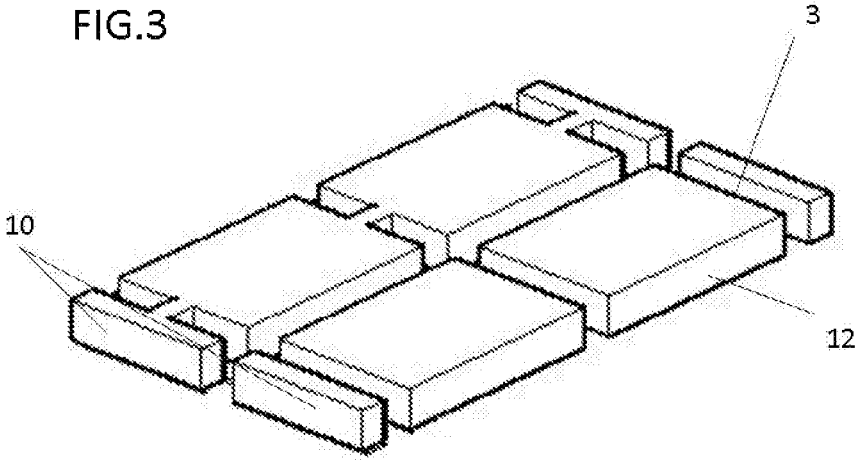
FIG. 3 shows two identical cross members arranged in different ways, showing the ends (10) and the sides (12) thereof, in one of which the recess of the narrowed segment (3) is facing up and in the other the recess of the narrowed segment is facing down.
Figure 4:
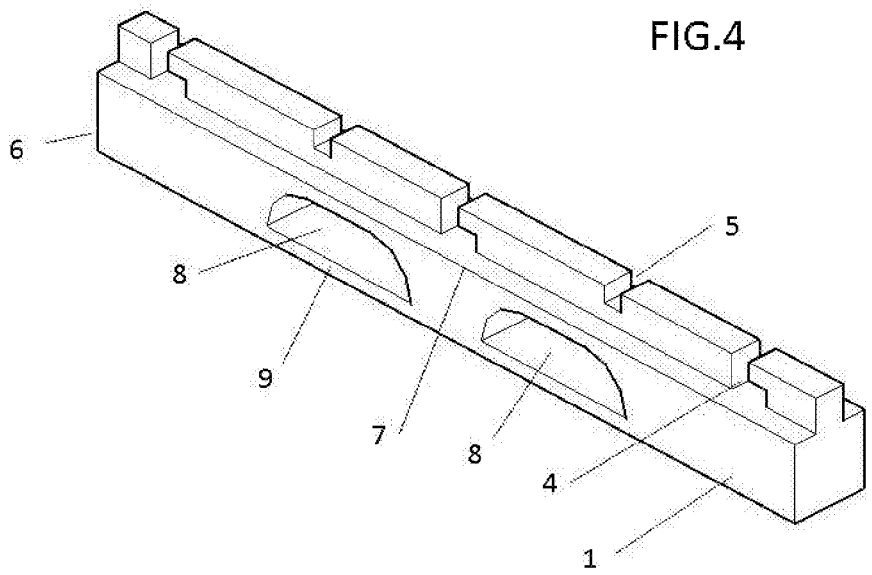
FIG. 4 shows a longitudinal member (1) with the slots (4), in this case with an L shape, the slots (5), the thickening (6) of the bottom part of the longitudinal member, the recesses (7), the cut-outs (8) with the tie rod (9) flush against the bottom surface of the longitudinal member.
Figure 5:
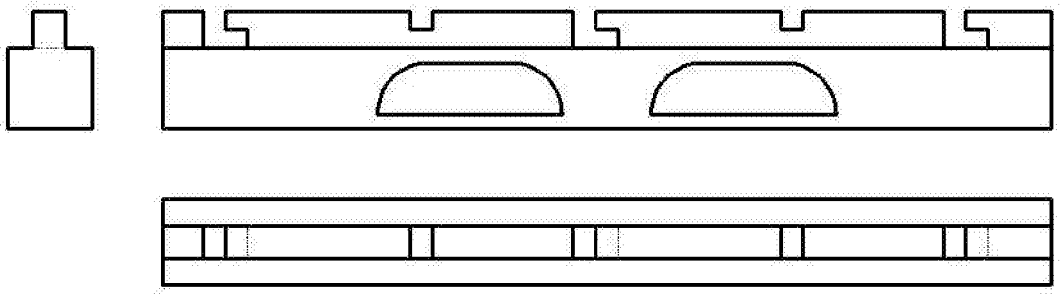
FIG. 5 shows, for greater clarity, the plan, elevation and side views of the longitudinal member.
Figure 6:
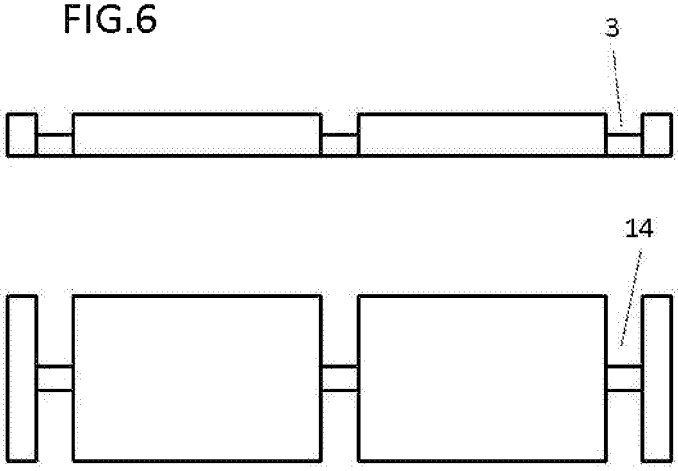
FIG. 6 shows the plan, elevation and side views of the cross member, showing the reduction (3) in the narrowed segment on only one of the faces thereof, while the side narrowed segment (14) is made symmetrically on both sides.

As indicated above, the invention relates to a dismantlable self-assembly structure applicable in several sectors, although the tests performed show that it is ideal for use in the transportation sector, specifically to make pallets; this example is used to explain an embodiment of the invention represented in FIGS. 1 and 2, which is not the only one possible.

The pallet according to the proposed embodiment comprises three longitudinal members (1) and five cross members (2).

Each one of the longitudinal members comprises an elongated parallelepiped body with the lower part thereof thicker than the upper part thereof, a recess (7) determining the difference in thickness between the lower and upper parts.

At the top part the longitudinal member has a number of slots (4) that prolong downward to form an "L".

Said slots are suitable for inserting therein the cross members (2) at the narrowed area thereof.

To do so it is necessary to arrange the longitudinal members parallel to each other with the openings of the slots (4) aligned.

At least one of the longitudinal members must be placed in the opposite direction to the others, that is, with a rotation about the vertical axis thereof; in the proposed embodiment the central longitudinal member is placed in the opposite direction to the other two.

After the cross members (2) have been inserted in the longitudinal members (1) it is necessary to align the slots (5) in the longitudinal members.

Due to the L shape of the slots, and since at least one of the cross members is placed in the opposite direction to the others, when the slots are aligned the cross member is trapped in the horizontal part of the L-shaped slots such that it cannot come out.

To fix the position of the longitudinal members an additional set of cross members are inserted in the slots (5), blocking the movement thereof and thereby preventing the cross members inserted in the slots from coming out, resulting in a compact and solid pallet.

With the pallet configured in this manner the ends (10) of the cross members rest on the recess (7) flush with the thickening (6) of the bottom part of the longitudinal members present at the ends of the pallet.

In addition, the sides (12) of the cross members are flush with the ends (13) of the longitudinal members.

The periphery of the pallet is therefore lacking protruding elements thereby facilitating handling operations.

Additionally, the pallet according to the proposed construction has reductions (8) at the bottom part closed on the bottom thereof by a tie rod (9).

Said reductions allow introducing the skids of a forklift to facilitate the handling of the pallets.

To increase the strength of the assembly said reductions are closed by tie rods (9) placed flush with the bottom surface of the longitudinal member.

Said tie rods allow transporting the pallets or the longitudinal members along a roller system by providing smooth and recess-free bottom planes.

The invention claimed is:

1. An improved dismantlable self-assembly structure, comprising a number of longitudinal members and cross members, including:

1. a set of identical longitudinal members each one of which comprises:
   a) A plurality slots of a first type which, in at least one point of the path thereof, do not run parallel to the vertical axis of the longitudinal member;
   b) At least one slot of a second type;
   c) A thickening in a lower part;
   d) A recess; and
2. a set of identical cross members, each one of which comprises a series of narrowed segments, ends and sides;

wherein slots of the first type and of the second type of the longitudinal members are configured to engage with the narrowed segments of the cross members so as to be rigidly fixed with respect to one another.

2. The improved dismantlable self-assembly structure of claim 1 wherein the longitudinal members have at least one cut-out in the lower part thereof.

3. The improved dismantlable self-assembly structure of claim 1 wherein the longitudinal members are arranged in parallel for the assembly thereof, at least one of said members being arranged in the opposite direction to the others.

4. The improved dismantlable self-assembly structure of claim 1 wherein the narrowed segments having a reduction in the thickness of the cross members, made only on one of the faces thereof.

5. The improved dismantlable self-assembly structure of claim 1 wherein, once assembled, the ends of the cross members rest on the recess and are flush with the bottom part of the longitudinal member provided with a thickening.

6. The improved dismantlable self-assembly structure of claim 1 wherein, once assembled, the sides of the cross members of the edges are flush with the ends of the longitudinal members.

7. An improved dismantlable self-assembly structure, comprising a number of longitudinal members and cross members, including:

1. a set of identical longitudinal members each one of which comprises:
   a) A plurality slots of a first type which, in at least one point of the path thereof, do not run parallel to the vertical axis of the longitudinal member;
   b) At least one slot of a second type;
   c) A thickening and at least one cut-out in a lower part, wherein the cut-outs are closed on the bottom by a connecting element that is flush with a bottom surface of the longitudinal member;
   d) A recess; and
2. a set of identical cross members, each one of which comprises a series of narrowed segments, ends and sides.

* * * * *